US012196518B2

(12) United States Patent
Miller

(10) Patent No.: US 12,196,518 B2
(45) Date of Patent: Jan. 14, 2025

(54) APPARATUS FOR REDUCING THE MANUAL CYCLING FORCE OF A FIREARM

(71) Applicant: Bart Miller, Littleton, CO (US)

(72) Inventor: Bart Miller, Littleton, CO (US)

( * ) Notice: Subject to any disclaimer, the term of this patent is extended or adjusted under 35 U.S.C. 154(b) by 0 days.

(21) Appl. No.: 18/543,556

(22) Filed: Dec. 18, 2023

(65) Prior Publication Data

US 2024/0151483 A1 May 9, 2024

Related U.S. Application Data

(62) Division of application No. 17/704,420, filed on Mar. 25, 2022, now Pat. No. 11,846,481.

(60) Provisional application No. 63/166,569, filed on Mar. 26, 2021.

(51) Int. Cl.
*F41A 3/86* (2006.01)
*F41A 3/82* (2006.01)

(52) U.S. Cl.
CPC ..... *F41A 3/86* (2013.01); *F41A 3/82* (2013.01)

(58) Field of Classification Search
CPC ..... F41A 3/80; F41A 3/82; F41A 3/86; F41A 19/03
See application file for complete search history.

(56) References Cited

U.S. PATENT DOCUMENTS

| | | | | |
|---|---|---|---|---|
| 4,485,723 | A | 12/1984 | Sarony | |
| 5,770,814 | A * | 6/1998 | Ealovega | F41A 19/04 89/131 |
| 10,816,287 | B1 * | 10/2020 | Russo | F41A 3/46 |
| 11,846,481 | B2 | 12/2023 | Miller | |
| 2014/0216243 | A1 | 8/2014 | Coffman, II | |
| 2021/0348867 | A1 * | 11/2021 | Reynolds | F41A 19/03 |
| 2023/0012703 | A1 * | 1/2023 | Salinas | F41A 3/80 |

OTHER PUBLICATIONS

Official Action for U.S. Appl. No. 17/704,420, dated May 19, 2023, 5 pages. Restriction Requirement.
Notice of Allowance for U.S. Appl. No. 17/704,420, dated Jul. 17, 2023, 9 pages.

* cited by examiner

*Primary Examiner* — J. Woodrow Eldred
(74) *Attorney, Agent, or Firm* — Sheridan Ross P.C.

(57) ABSTRACT

Apparatuses, systems, and methods are provided for selectively changing the force required to cycle a firearm. In some embodiments, an apparatus is provided with at least two biasing members or springs where one biasing member generates a softer or smaller force than another biasing member. When manually cycling the firearm, the softer biasing member reduces the effort required for a person to cycle the firearm, which reduces the likelihood of injury and allows people with a broader range of physical abilities to cycle the firearm. Then, when the firearm fires a round, the other biasing member provides the greater force required to cycle the firearm in a conventional, semi-automatic or automatic manner.

20 Claims, 6 Drawing Sheets

APPARATUS FOR REDUCING THE MANUAL CYCLING FORCE OF A FIREARM

CROSS-REFERENCE TO RELATED APPLICATION

This application is a divisional of U.S. patent application Ser. No. 17/704,420 filed on Mar. 25, 2022, which claims priority and benefits under 35 U.S.C. § 119(e) to U.S. Provisional Patent Application Ser. No. 63/166,569 filed on Mar. 26, 2021, which is incorporated herein in its entirety by reference.

FIELD

The present disclosure is directed to firearms that incorporate springs or biasing members to manually cycle a firearm and specifically directed to reducing the manual force required to open the slide of the firearm.

BACKGROUND

Firearms are commonly used for hunting, competition, and self-defense. Some firearms are semi-automatic, meaning that after a round is fired, the firearm automatically ejects the casing of the fired round and loads another round to be fired. Then, a user can manually pull the trigger of the firearm to cause the newly-loaded round to fire. Many different arrangements of components within a firearm can achieve this semi-automatic functionality. For a pistol, a biasing member such as a spring operates with other components to achieve semi-automatic functionality. As shown in FIG. 1, a semi-automatic pistol 2 has a frame 4, which the user grasps, and a trigger 6 positioned within the frame 4. Then, the pistol 2 has a slide 8 that houses a barrel 10 and a biasing assembly 12 that has a biasing member 14, and the slide 8 is movable relative to the frame 4, as controlled by the biasing member 14.

When a user pulls the trigger 6 of a semi-automatic pistol 2, a hammer or striker is released, which strikes the primer of a round. The primer ignites the propellant of the round, which forces the bullet through the barrel 10 at great speed and acceleration. For every force there is an equal and opposite reaction, and as the propellant forces the bullet through the barrel 10, the slide 8 moves backward relative to the frame 4. A biasing member 14 between the slide 8 and the frame 4 compresses as the slide 8 moves backward. During the backward motion, the slide 8 causes the casing of the fired round to eject away from the firearm 2. The backward travel of the slide 8 is stopped by a contact surface of the frame 4, and the biasing member 14, having been compressed, can now drive the slide 8 forward to its initial position. As the slide 8 moves forward, it draws another round into position to be fired. One feature of many semi-automatic firearms 2 is the ability of a user to rack or move the slide 8 backward and forward as described above without firing a round. Therefore, the user can eject a round and/or load a new round without firing a round.

One issue with semi-automatic firearms 2 is that a biasing member 14 can be exceedingly stiff or strong for a person to manually rack or move the slide 8 to see if the firearm 2 is loaded, eject and/or load a round. This issue is particularly acute in pistols 2 where the biasing member 14 must be much stronger or stiffer because the slide is shorter and, as such, has less mass to absorb recoil, and there is less distance to cycle the firearm 2. In other words, since the pistol 2 is physically smaller compared to a rifle or shotgun, the biasing member 14 must absorb the force from a round firing and then drive the slide 8 forward to its initial position within a short distance. As such, the biasing member 14 must be strong or stiffer. This causes problems when a person with less grip strength or less overall strength tries to manually rack or move the slide 8. A user may injure himself or herself trying to overcome the strong or stiff biasing member 14. Further still, the user may be placed in a vulnerable position during a self-defense situation if the firearm 2 jams or the user is otherwise unable to rack or move the slide 8 and make the firearm 2 operational.

SUMMARY

The above shortcomings and other needs are addressed by the various embodiments and configurations of the present disclosure. It is an objective of the present disclosure to provide an apparatus that has a primary spring or biasing member for manual operation of the firearm and a secondary spring or biasing member for semi-automatic operation, or even automatic operation, of the firearm. The primary spring or biasing member is less resilient or stiff than the factory recoil spring or biasing member, allowing a user to more easily rack or move the slide in a manual fashion. The secondary spring or biasing member remains to provide the necessary force to automatically cycle the firearm as rounds are fired. As a result, all functions of a firearm can be operated by users that have less than average strength, and users will be placed into fewer vulnerable positions during a self-defense situation since operating the slide manually is now easier than a typical firearm which utilizes the same biasing member for both of manual and semi-automatic operations. It also allows for safer operation of the slide and the firearm overall since the user does not have to struggle to rack the slide during loading or checking to see if a live round remains in the chamber.

It is an aspect of embodiments of the present disclosure to provide an apparatus for a firearm where the apparatus has multiple biasing members, and one of the biasing members is selectively engaged during automatic cycling of the firearm as rounds are fired. In some embodiments, the apparatus comprises a secondary biasing member disposed within a guide tube and a primary biasing member disposed around the guide tube and around the secondary biasing member. As explained in further detail herein, a bushing assembly positioned around the guide tube selectively engages the secondary biasing member. Specifically, in a first mode of operation the bushing assembly does not engage the secondary biasing member and compresses the primary biasing member alone. In this mode, the user is manually racking or moving the slide to cycle and operate the firearm. Since only the primary biasing member is compressed, less force is required to rack or move the slide. In a second mode of operation, the bushing assembly engages the secondary biasing member and compresses both of the primary and secondary biasing members. In this mode, the firearm has fired a round and the force exerted by both biasing members, in particular the secondary biasing member, allows the firearm to cycle like a conventional semi-automatic firearm.

Firearms such as pistols typically have a biasing member with a particular force constant to ensure reliable operation of the pistol. A biasing member such as a spring has a force constant expressed in force per unit of displacement. For example, a spring with a force constant of 10 lbs/inch will exert 10 lbs of force when compressed by 1 inch, 20 lbs of force when compressed by 2 inches, etc. In the context of pistols, a "spring weight" is similar to a force constant, but a spring weight describes the amount of force exerted by a spring when the slide is in the rearward and locked position, and the spring is at its most compressed or displaced position. Most prior art pistols have a biasing member or spring with a spring weight between 16 lbs and 22 lbs.

In the present disclosure, in one mode of operation only one biasing member is engaged when manually racking the slide, and in another mode of operation two biasing members are engaged when the pistol is fired. With an apparatus of the present disclosure installed, the primary biasing member can provide ½ to ⅓ of the normal factory recoil spring weight or resistance while the secondary biasing member can provide the remainder of the normal factor spring weight or resistance needed for the pistol to operate properly while being fired. Thus, in some embodiments of the present disclosure, the primary biasing member can have a spring weight of between approximately 5 lbs and 11 lbs, and the secondary biasing member can have a spring weight of between approximately 5 lbs and 17 lbs. It will be appreciated that the values for these spring weights are exemplary in nature, and the present disclosure encompasses a variety of spring weights or other characteristics of a spring or biasing member.

Moreover, it will be appreciated that the biasing members and/or springs described herein can have a linear and/or nonlinear force response to physical displacement. In addition, although the second force constant of the secondary biasing member is described as greater than the first force constant of the primary biasing member, in some embodiments, the second force constant may be equal to or less than the first force constant.

It is an aspect of embodiments of the present disclosure to provide an apparatus for a firearm that selectively engages the secondary biasing member only when the firearm fires a round and not when a user manually cycles the firearm. In some embodiments, the primary and secondary biasing members are arranged in parallel, and a bushing biasing member between sub-components of the bushing assembly is arranged in series with the primary biasing member. The sub-components or cam bushings rotate relative to each other as the bushing biasing member compresses, for example, in response to a user racking the slide or the firearm firing a round. However, the cam bushings rotate relative to each other more quickly in response to a firearm firing compared to a user racking a slide. As a result of the quick rotation, the cam bushings rotate relative to each other sooner at a different location along the guide tube such that a bushing stud on one of the cam bushings contacts a piston stud on a piston, which then compresses the secondary biasing member. In contrast, when a user manually racks or moves the slide, the bushing stud passes the piston stud without engaging the piston stud, and only the primary biasing member is compressed.

In some instances, a force imposed at one end of the primary biasing member is evenly distributed along the length of the primary biasing member. Thus, in the first mode of operation, the force imposed by a user manually moving or racking the slide is evenly distributed along the primary biasing member. However, embodiments of the present disclosure utilize spring motion and a compression wave in the second mode of operation where the cam bushings rotate more quickly relative to each other which causes the bushing assembly to engage the secondary biasing member. When the end of the bushing assembly is subjected to the sudden force of the slide moving in response to a fired round, the bushing assembly experiences more force than the primary biasing member. This uneven force distribution causes the cam bushings to rotate relative to each other sooner at a different location along the guide tube. As explained above, this causes engagement of the secondary biasing member. Thus, the force impulse and/or acceleration associated with the firing of a round results in a different operation of the apparatus compared to a user moving or racking the slide. As a result, the engagement of the secondary biasing member is dependent on one or more of an increased force applied to the firearm slide, an increased velocity of the slide, the acceleration of the slide, a momentum of the slide, or a combination of the force, velocity, acceleration, or momentum of the slide.

In an exemplary embodiment, the acceleration of the slide, and thus, components of the apparatus described herein, can be between approximately 1040 $m/s^2$ and 2750 $m/s^2$ with a force impulse of approximately 2200 N. These values can vary greatly depending on the make and model of firearm, ammunition, the type of firearm (pistol, rifle, shotgun), etc. Thus, in some embodiments, a range of accelerations or force impulses can be established for a firearm, family of firearms, caliber, etc. Then, below a predetermined acceleration or force impulse, the apparatus described herein operates in a first mode, and above the predetermined acceleration or force impulse, the apparatus operates in a second mode. This predetermined value can be less than the lower bound of the expected range of values for the firearm, family of firearms, caliber, etc. In some embodiments, the predetermined value is half of the lower bound, 10% less than the lower bound, etc.

This distinction between modes of operation can also be characterized by a sufficient impact caused by a firearm firing a round. When a sudden force with sufficient impact, such as during recoil when the firearm is fired, is applied to the front of a male rotary cam bushing by the rearward moving part of the firearm it causes the rotary cam bushing assembly to move rearward rapidly. This causes the cam surface of the male rotary bushing to engage the cam surface of the female rotary bushing with enough force to rotate the female rotary cam bushing against the rotational force or winding resistance of the primary spring and allow the rotary cam bushings to fully engage with each other before the primary spring can begin to move out of the way.

When this happens, the studs located on the underside of the female rotary cam bushing align with the studs located on the outside of the secondary recoil spring piston thereby pushing the secondary spring piston rearward and compressing the secondary spring which increases resistance of the rearward movement of the slide so it can move at a proper safe and controlled speed. After firing the firearm and the recoil assembly is fully compressed in its rearward movement the primary and secondary springs push forward on the rotary cam bushing assembly. The parts travel forward until they reach their respective stop positions. At this point, the rotational force or winding resistance of the primary spring resets the rotary cam bushings into their at rest position, and the mechanism has completed one cycle of operation under recoil.

In some embodiments, ends of the primary biasing member can extend into recesses in the second bushing and in the guide tube to set the rotational force of the primary biasing member that remains substantially constant as the apparatus functions in various modes of operation. Once the primary biasing member is compressed during a cycle, the longitudinal force exerted by the primary biasing member is greater than the rotational force. As the primary biasing member extends, the longitudinal force becomes less than the rotational force. At this point, the cam surfaces of the bushing assembly act to rotate and reset the second bushing to its initial position at the beginning of the cycle.

It will be appreciated that the present disclosure encompasses embodiments that include sensors and/or electric actuators. In addition, in some embodiments, the bushing assembly or other component within the pistol or other firearm may comprise a sensor such as an accelerometer or other similar device that can detect acceleration, speed, force, momentum, etc. The bushing assembly can also comprise a device such as a solenoid or other electronically activated mechanism that dictates the position of the bushing stud, and thus, whether the bushing assembly and the overall device operates in a first mode or second mode. For instance, in one embodiment a round is fired and the sensor on the bushing assembly detects an acceleration, a speed, a force, or a momentum above a predetermined threshold. As a result, the solenoid drives and rotates the second bushing relative to the first bushing, which causes the bushing stud to contact and engage the piston stud for the second mode of operation. If the predetermined threshold is not crossed, then the solenoid does not move the second bushing relative to the first bushing, and the device operates in the first mode. For the various electronics required to operate between a first mode and a second mode, a battery device may be associated with the device which can be rechargeable or use replaceable batteries. As appreciated by one of skill in the art, the actual mechanism used to sense the operational mode of the firearm and whether the first or second mode should be activated could comprise any known devices and the current concept is not limited to an accelerometer, a solenoid or a particular bushing assembly.

It is an aspect of embodiments of the present disclosure to provide an apparatus, as described herein, that replaces an existing spring assembly in a firearm. Thus, a firearm with a standard spring assembly is easily retrofitted with an apparatus as described herein. To retrofit most pistols, the slide is removed from the frame, the standard spring assembly is removed, the new apparatus as described herein is inserted, and the slide and frame are put back together without any alterations to the firearm. Now, the manual cycling force of a firearm is reduced as described herein without adjustment or modification to the firearm.

While embodiments of the present disclosure are described with respect to a firearm, it will be appreciated that embodiments of the present disclosure can be utilized with any application where selective engagement of biasing members is a benefit. Additional embodiments of the present disclosure are shown in Appendices A, B, C, and D, which are incorporated herein in their entireties by reference.

One particular embodiment of the present disclosure is an apparatus for selectively changing a cycling force of a firearm, comprising a primary biasing member having a first force constant; a secondary biasing member having a second force constant; a bushing assembly operably engaged with one end of the primary biasing member; a piston operably engaged with one end of the secondary biasing member; wherein, in response to a first force on the bushing assembly, the bushing assembly compresses only the primary biasing member; and wherein, in response to a second force that is greater than the first force on the bushing assembly, the bushing assembly engages the piston such that the bushing assembly compresses both of the primary biasing member and the secondary biasing member.

In some embodiments, the bushing assembly comprises a first bushing with a first cam surface and a second bushing with a second cam surface, wherein the first and second cam surfaces operably engage as the first and second bushings move toward each other along a longitudinal axis to rotate the second bushing from a first position to a second position where the second bushing can selectively engage the piston. In various embodiments, the apparatus further comprises a bushing stud extending from an inner surface of the second bushing; and a piston stud extending from an outer surface of the piston, wherein the bushing stud selectively engages the piston stud to selectively compress both of the primary and secondary biasing members.

In some embodiments, the primary biasing member has a rotational force; wherein, when the primary biasing member is at a first displacement, a longitudinal force from the primary biasing member is greater than the rotational force, and the second bushing is in the first position; and wherein, when the primary biasing member is at a second displacement that is greater than the first displacement, the longitudinal force from the primary biasing member is less than the rotational force, and the second bushing is reset to the second position.

In various embodiments, the second force causes the second bushing to rotate to the second position faster than the first force. In some embodiments, the apparatus further comprises a guide tube, wherein the primary biasing member and the bushing assembly are disposed around the guide tube, and the secondary biasing member and the piston are disposed in an interior volume of the guide tube. In various embodiments, the second force constant is greater than the first force constant.

Another particular embodiment of the present disclosure is an apparatus for selectively changing a cycling force of a semi-automatic firearm, comprising a primary biasing member having a first force constant and a rotational force; a secondary biasing member having a second force constant, wherein the primary and secondary biasing members are oriented along a longitudinal axis; a bushing assembly having a first bushing with a first cam surface and having a second bushing with a second cam surface, wherein the first and second cam surfaces operably engage as the first and second bushings move toward each other along the longitudinal axis to rotate the second bushing from a first position to a second position; wherein, when the primary biasing member is at a first displacement, a longitudinal force from the primary biasing member is greater than the rotational force, and the second bushing is in the second position; and wherein, when the primary biasing member is at a second displacement that is greater than the first displacement, the longitudinal force from the primary biasing member is less than the rotational force, and the rotational force resets the second bushing to the first position.

In some embodiments, the apparatus further comprises a piston positioned in a guide tube, wherein a bushing stud extends from an inner surface of the second bushing, and a piston stud extends from an outer surface of the piston, wherein the bushing stud selectively engages the piston stud to selectively engage the secondary biasing member. In various embodiments, the apparatus further comprises a channel extending through a sidewall of the guide tube, wherein the bushing stud and the piston stud extend into the channel.

In some embodiments, a guide stud extends inwardly from the first bushing into a groove of the guide tube to fix a rotational position of the first bushing as the first bushing moves along the guide tube. In various embodiments, the first cam surface is oriented at a first cam angle, and the second cam surface is oriented at a second cam angle that complements the first cam angle, wherein the first and second cam angles control the timing and selective engagement of the piston stud by the bushing stud. In some embodiments, the first and second cam surfaces are flat to provide a linear relationship between movement of the second bushing along the longitudinal axis and rotation of the second bushing between the first and second positions. In various embodiments, the first cam surface is one of a plurality of first cam surfaces that are equally spaced about the first bushing, and the second cam surface is one of a plurality of second cam surfaces that are equally spaced about the second bushing.

A further particular embodiment of the present disclosure is an apparatus for selectively changing a cycling force of a semi-automatic firearm, comprising a guide tube adapted to be positioned in a slide of the semi-automatic firearm, wherein the guide tube extends from a first end to a second end, and the guide tube has an interior volume and a channel providing access into the interior volume; a primary biasing member disposed around the guide tube; a bushing assembly disposed around the guide tube and positioned at one end of the primary biasing member, wherein the bushing assembly has a bushing stud extending inwardly into the channel; a secondary biasing member disposed in the interior volume of the guide tube; a piston positioned in the interior volume of the guide tube and positioned at one end of the secondary biasing member, wherein the piston has a piston stud extending outwardly into the channel; wherein, in response to a first speed of the slide, the bushing stud passes the piston stud such that the bushing assembly compresses only the primary biasing member; and wherein, in response to a second speed of the slide that is faster than the first speed, the bushing stud engages the piston stud such that the bushing assembly compresses both of the primary and secondary biasing members.

In some embodiments, the apparatus further comprises a second channel and a third channel in the guide tube providing access into the interior volume; a second bushing stud extending inwardly into the second channel, and a second piston stud extending outwardly into the second channel, wherein the second bushing stud passes the second piston stud in response to the first speed, and the second bushing stud engages the second piston stud in response to the second speed; and a third bushing stud extending inwardly into the third channel, and a third piston stud extending outwardly into the third channel, wherein the third bushing stud passes the third piston stud in response to the first speed, and the third bushing stud engages the third piston stud in response to the second speed.

In various embodiments, the guide tube extends along a longitudinal axis, and the channels are equally spaced about the longitudinal axis. In some embodiments, the apparatus further comprises a cap that is threadably engaged to the first end of the guide tube, wherein a length of the cap controls a position of the piston in the interior volume of the guide tube, and the position of the piston controls the timing and selective engagement of the piston stud by the bushing stud. In various embodiments, the apparatus further comprises a first recess in the bushing assembly and a second recess in the second end of the guide tube, wherein ends of the primary biasing member extending into the first and second recesses to establish a rotational force of the primary biasing member. In some embodiments, the first recess is one of a plurality of first recesses in the bushing assembly, and the second recess is one of a plurality of second recesses to adjust the rotational force of the primary biasing member.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements or components. Additional aspects of the present disclosure will become more readily apparent from the Detailed Description, particularly when taken together with the drawings. In addition, details about the present disclosure can be found in the Appendices, which are incorporated in their entireties by reference.

The above-described embodiments, objectives, and configurations are neither complete nor exhaustive. As will be appreciated, other embodiments of the disclosure are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and claims themselves.

BRIEF DESCRIPTION OF THE DRAWINGS

The accompanying drawings, which are incorporated in and constitute a part of the specification, illustrate embodiments of the disclosure and together with the Summary given above and the Detailed Description of the drawings given below, serve to explain the principles of these embodiments. In certain instances, details that are not necessary for an understanding of the disclosure or that render other details difficult to perceive may have been omitted. It should be understood, of course, that the disclosure is not necessarily limited to the particular embodiments illustrated herein. Additionally, it should be understood that the drawings are not necessarily to scale.

Figure 1:
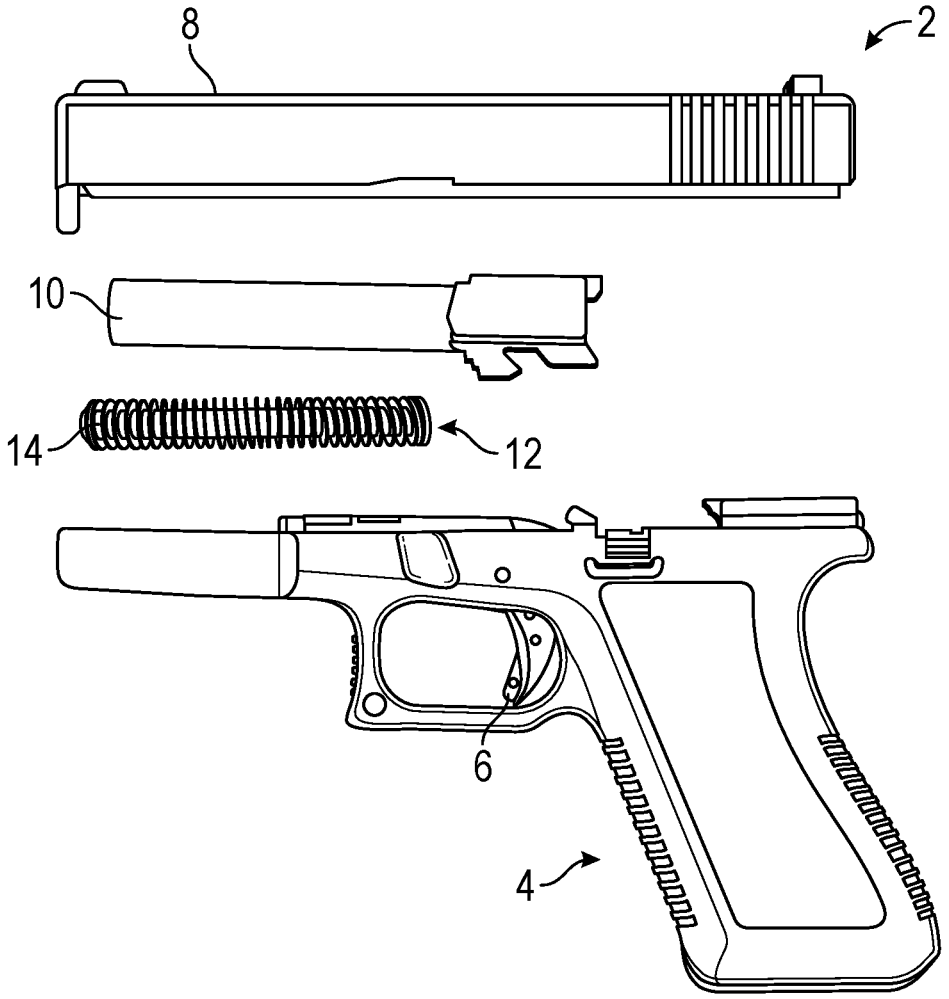
FIG. 1 (Prior Art)
FIG. 1 is a side elevation view of a prior art pistol and its components.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Number | Component |
|---|---|
| 2 | Pistol |
| 4 | Frame |
| 6 | Trigger |
| 8 | Slide |
| 10 | Barrel |
| 12 | Biasing Assembly |
| 14 | Biasing Member |
| 16 | Apparatus |
| 18 | Guide Tube |
| 20 | Primary Biasing Member |
| 22 | Bushing Assembly |
| 24 | Secondary Biasing Member |
| 26 | First Bushing |
| 28 | Second Bushing |
| 30 | First Cam Surface |
| 32 | Second Cam Surface |
| 36 | Piston |
| 38 | Guide Cap |
| 40 | Piston Stud |
| 42 | Channel |
| 44 | Longitudinal Axis |
| 46 | Groove |
| 48 | First End |
| 50 | Second End |
| 52a, 52b, 52c | First Recess |
| 54a, 54b | Second Recess |
| 56 | Guide Stud |
| 58 | Bushing Stud |
| 60 | First Path |
| 62 | Second Path |
| 64 | Longitudinal Force |
| 66 | Rotational Force |

DETAILED DESCRIPTION

The present disclosure has significant benefits across a broad spectrum of endeavors. It is the Applicant's intent that this specification and the claims appended hereto be accorded a breadth in keeping with the scope and spirit of the disclosure being disclosed despite what might appear to be limiting language imposed by the requirements of referring to the specific examples disclosed. To acquaint persons skilled in the pertinent arts most closely related to the present disclosure, a preferred embodiment that illustrates the best mode now contemplated for putting the disclosure into practice is described herein by, and with reference to, the annexed drawings that form a part of the specification. The exemplary embodiment is described in detail without attempting to describe all of the various forms and modifications in which the disclosure might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present disclosure are described herein and as depicted in the drawings. It is expressly understood that although the figures depict an apparatus for selectively changing the cycling force of a firearm, the present disclosure is not limited to these embodiments. Moreover, it will be appreciated that the term "biasing member" encompasses not only springs, but also bellows, elastomeric or other resilient materials, etc.

Figure 2:
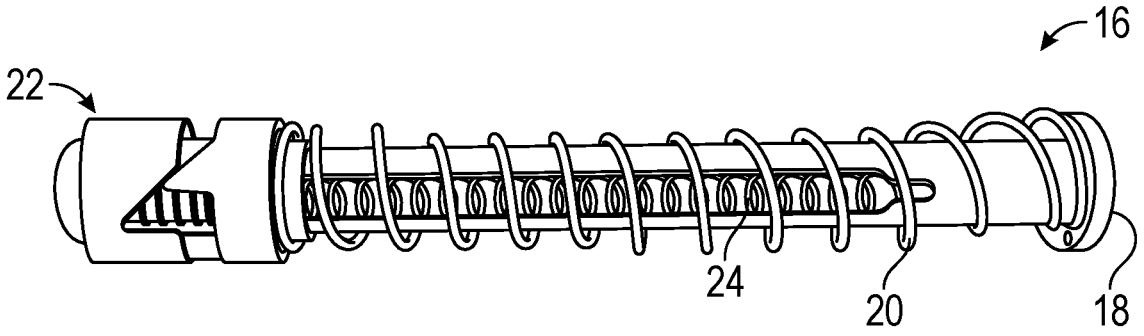
FIG. 2 is a side elevation view of an apparatus for selectively changing the cycling force of a firearm in accordance with an embodiment of the present disclosure.

Now referring to FIG. 2, a side elevation view of an apparatus 16 according to the present disclosure is provided. As noted above with respect to FIG. 1, a prior art biasing assembly has a single biasing member for any mode of operation, whether a user is manually racking the slide of the pistol or firing the pistol. In contrast, the apparatus 16 of the present disclosure has two biasing members, a primary biasing member 20 and a secondary biasing member 24, for use in different modes of operation. Specifically, the primary biasing member 20 is lighter with a smaller force constant to make manually racking the slide of a pistol easier for various users. Then, the secondary biasing member 24 is heavier with a greater force constant to aid in the operation of the pistol as it fires.

In this embodiment, the primary biasing member 20 is disposed about a guide tube 18, and the secondary biasing member 24 is disposed within an interior volume of the guide tube 18. A bushing assembly 22 selectively engages the secondary biasing member 24 in different modes of operation. Specifically, in a first mode of operation, a user manually racks the slide with a smaller force that acts on the bushing assembly 22. The bushing assembly 22 compresses the primary biasing member 20 but not the secondary biasing member 24, which makes racking the slide much easier. Then, in a second mode of operation, the pistol fires, which imposes a greater force on the bushing assembly 22, which causes the bushing assembly 22 to engages both of the primary and secondary biasing members 20, 24 to provide a sufficient biasing action to operate the pistol as it fires.

Figure 3:
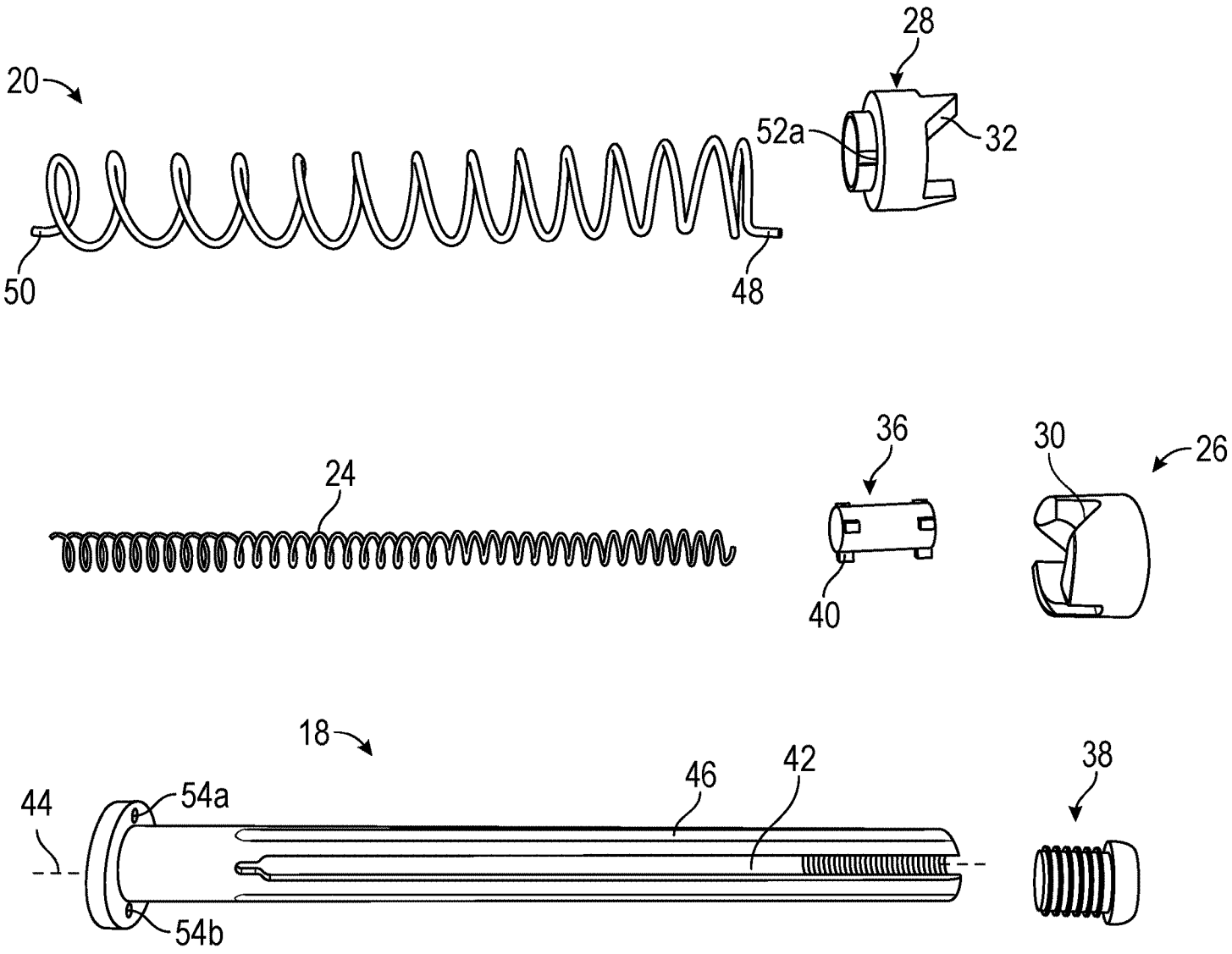
FIG. 3 is a side elevation view of components of the apparatus in FIG. 2 in accordance with an embodiment of the present disclosure.

Now referring to FIG. 3, a side elevation view of various components of the apparatus in FIG. 2 is provided. The bushing assembly generally comprises a first bushing 26 and a second bushing 28 that operably engage with each other to selectively engage the secondary biasing member 24 in different modes of operation, as discussed herein. Specifically, the first bushing 26 has a first cam surface 30, and the second bushing 28 has a second cam surface 32 that operably engage each other. The first bushing 26 remains in a fixed rotational position as the first bushing 26 moves in a longitudinal direction along the guide tube 18 in any mode of operation. Thus, the cam surfaces 30, 32 engage each other to rotate the second bushing 28 between a first rotational position and a second rotational position to selectively engage the secondary biasing member 24.

In the depicted embodiment, the first and second cam surfaces 30, 32 are flat, and movement of the second bushing 28 toward the first bushing 26 along a longitudinal axis 44 translates to rotational movement of the second bushing 28 in a linear relationship. Moreover, the depicted angles of the cam surfaces 30, 32 are approximately 45 degrees, and the cam surfaces 30, 32 complement each other. The term "approximately" can imply a variation of +/−10% on a relative basis. However, it will be appreciated that the cam surfaces 30, 32 can be changed to alter the operation of the bushing assembly. The angles of the cam surfaces 30, 32 can be changed to change the manner in which the second bushing 28 rotates to selectively engage the secondary biasing member 24. In other words, these angles can dictate how quickly the second bushing 28 rotates in response to a force impulse and/or acceleration associated with the pistol firing a round. It will be appreciated that the present disclosure encompasses other embodiments with other cam surface angles and other cam surface shapes to create other relationships between the longitudinal and rotational movement of the second bushing 28.

The secondary biasing member 24 and a piston 36 are positioned within the guide tube 18, and a guide cap 38 is secured to one end of the guide tube 18 to secure the secondary biasing member 24 and the piston 36 within the guide tube 18. The guide cap 38 along with a flanged end of the guide tube secure the primary biasing member 20 and the bushing assembly around the guide tube 18. The piston 36 positioned at one end of the secondary biasing member 24 has a piston stud 40 that extends outwardly into a channel 42 cut through a sidewall of the guide tube 18. A bushing stud extending inwardly from the second bushing 28 and into the channel 42 to selectively engage the piston stud 40. As a user manually racks the slide in a first mode of operation, the bushing stud does not engage the piston stud 40, and the bushing assembly compresses only the primary biasing member 20. As a user fires the pistol in a second mode of operation, the bushing stud engages the piston stud 40 such that both of the primary and secondary biasing members 20, 24 are compressed.

In the depicted embodiment, the guide tube 18 has three channels 42 evenly spaced around the longitudinal axis 44 of the guide tube 18. Similarly, the piston 36 has three piston studs 40, and the second bushing 28 has three bushing studs. Then, the guide tube 18 has a groove 46 cut into the sidewall. A guide stud extends from an inner surface of the first bushing 26 into the groove 46 to hold the rotational position of the first bushing 26 as the first bushing 26 moves along the guide tube 18. In the depicted embodiment, the guide tube 18 has three grooves 46 evenly spaced around the longitudinal axis 44 of the guide tube 18, and the first bushing 26 has three corresponding guide studs.

Next, the primary biasing member 20 imparts a rotational force on the second bushing to reset the rotational position of the second bushing after any mode of operation. The primary biasing member 20 has a first end 48 and a second end 50 that each extends away from the helical shape of the rest of the biasing member to engage a first recess 52*a* in the second bushing 28 and a second recess 54*a* in the guide tube 18, respectively. The connection between the ends 48, 50 and the recesses 52*a*, 54*a* secure the primary biasing member 20 in position and also set a rotational force that the primary biasing member 20 imposes on the second bushing 28. Each of the second bushing 28 and the guide tube 18 can have multiple recesses to accommodate several different positions of the ends 48, 50 of the primary biasing member 20 to establish many different rotational forces. Moreover, for example, the second bushing 28 can have more recesses than the guide tube 18 provide for fine adjustment versus coarse adjustment of the rotational force, or vice versa.

Figure 4:
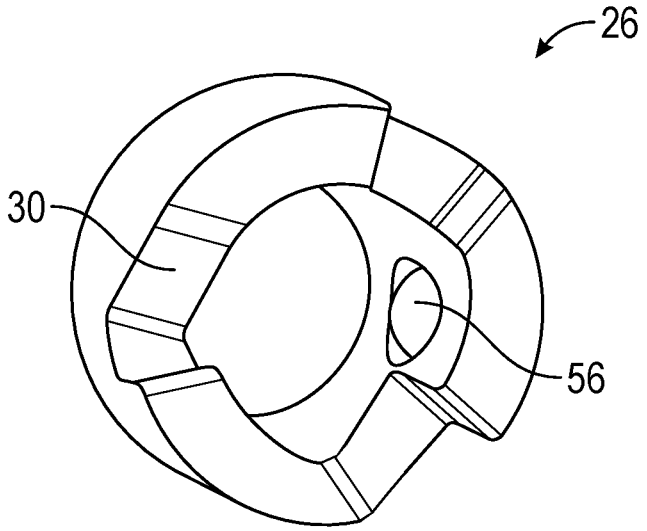
FIG. 4 is a perspective view of a first bushing from FIG. 3 in accordance with an embodiment of the present disclosure.

Now referring to FIG. 4, a perspective view of the first bushing 26 is provided. From this view the first cam surface 30 is shown, and also a guide stud 56 that engages the groove on the guide tube is shown. The first bushing 26 has three guide studs 56 equally spaced about an inner surface of the first bushing 26. Though the guide stud 56 is shown as having a generally circular or spherical shape, other shapes are contemplated. For instance, the guide stud 56 may have a hexagonal shape or a shape with at least one flat surface to prevent rotation or canting of the first bushing 26 as the first bushing 26 moves along the guide tube.

Figure 5:
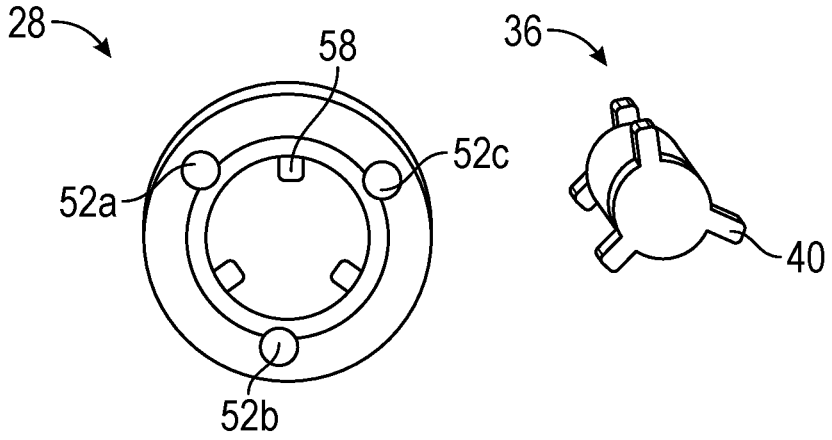
FIG. 5 is a perspective view of a second bushing and a piston from FIG. 3 in accordance with an embodiment of the present disclosure.

Now referring to FIG. 5, a perspective view of the second bushing 28 and the piston 36 is provided. Various recesses 52*a*-52*c* are shown where an end of the primary biasing member can be selectively inserted to establish the rotational force of the primary biasing member. Next, the second bushing 28 has three bushing studs 58 that selectively engage corresponding piston studs 40 on the piston 36.

It will be appreciated that some embodiments of the present disclosure can have three bushing studs, three piston studs, three pairs of cam surfaces, and three channels in the guide tube as well as three guide studs and three grooves in the guide tube to prevent rotation between the first bushing and the guide tube, all evenly arrayed around the longitudinal axis of the guide tube. This configuration provides stability to the bushing assembly in the different modes of operation. Moreover, this configuration evenly distributes forces about the longitudinal axis as the cam surfaces engage each other and as the bushing studs contact and engage the piston studs in the second mode of operation. However, it will be appreciated that other embodiments may have fewer or greater than three sets of bushing studs, piston studs, channels in the guide tube, pairs of cam surfaces, grooves, and guide studs.

Figure 6A:
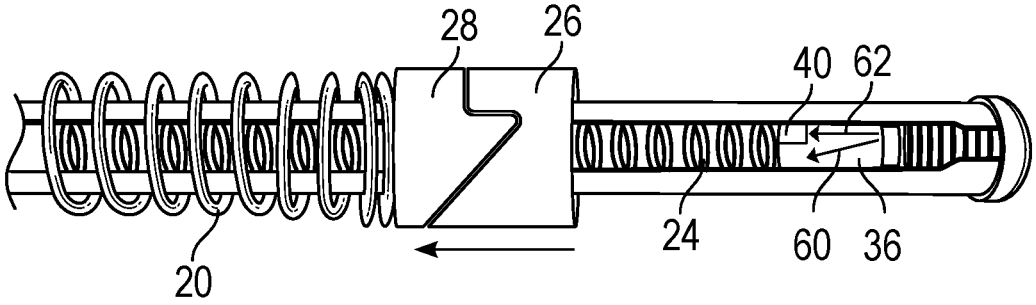
FIG. 6A is a side elevation view of the apparatus in FIG. 2 in a first mode of operation in accordance with an embodiment of the present disclosure.
Figure 6B:
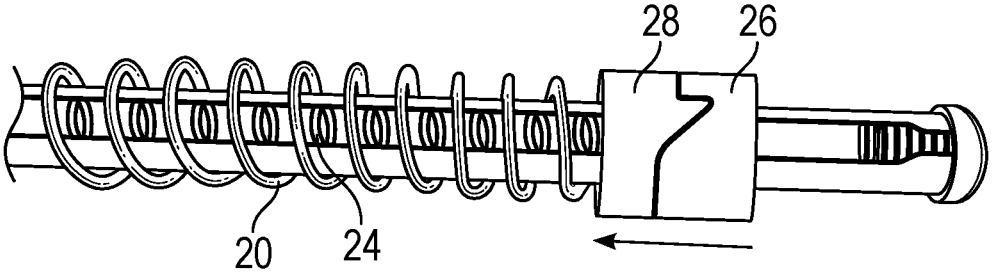
FIG. 6B is a side elevation view of the apparatus in FIG. 2 in a second mode of operation in accordance with an embodiment of the present disclosure.

Now referring to FIGS. 6A and 6B, side elevation views of the apparatus in a first mode of operation and a second mode of operation are provided, respectively. The first bushing 26 remains in the same rotational position during the cycling of the slide of the pistol in any mode of operation, but the second bushing 28 rotates between a first position and a second position as the cammed surfaces of the bushings 26, 28 engage each other. The second bushing 28 is in the first position as shown in FIG. 2, and the second bushing 28 is in the second position as shown in either FIG. 6A or FIG. 6B. Thus, the second bushing 28 rotates to the second position in either mode of operation, but the manner in which the second bushing 28 rotates to the second position controls whether the second bushing 28 engages the piston and the secondary biasing member for the second mode of operation where the pistol is firing.

FIG. 6A shows two paths that a bushing stud can travel as the second bushing 28 rotates from the first position to the second position. On a first path 60, and in response to a smaller force as a user manually racks the slide during a first mode of operation, the second bushing 28 rotates slowly, and the bushing stud travels by the piston stud 40 without engaging the piston stud 40. On a second path 62, and in response to a greater force as a user fires the pistol during a second mode of operation, the second bushing 28 rotates quickly, and the bushing stud contacts and engages the piston 40, as shown in FIG. 6B. The much greater force impulse and/or acceleration causes the second bushing 28 to rotates more quickly to engage the piston, which compresses the secondary biasing member as the bushing assembly compresses the primary biasing member. The width of the channel cut into the guide tube can be described as being at least as large as the combination of the width of the piston stud 40 and the width of the bushing stud to allow the different paths 60, 62 of the bushing stud.

Various aspects of the apparatus can be adjusted to accommodate many different types of firearms, ammunitions, etc. A given firearm and/or ammunition can require a certain range of forces acting on different components of the firearm at different times and location to ensure that the firearm functions properly. Yet the apparatus must also function to ensure that the bushing engages the piston. Thus, the force constants of the biasing members 20, 24, the cam surfaces of the bushing assembly, the size and position of the piston, as established by the guide cap, and other components can be adjusted to ensure that the apparatus functions as intended in any mode of operation.

Figure 7:
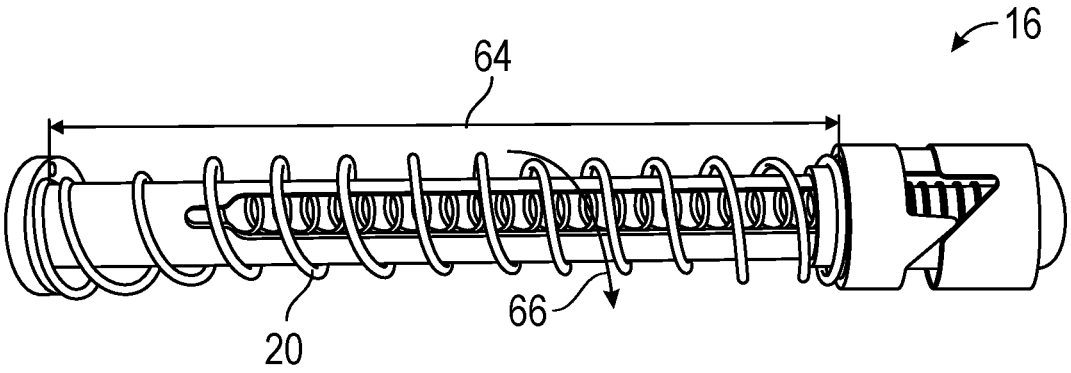
FIG. 7 is a further side elevation view of the apparatus in FIG. 2 in accordance with an embodiment of the present disclosure.

Now referring to FIG. 7, a further side elevation view of the apparatus 16 is provided. As noted above, the second bushing 28 rotates from a first position to a second position in any mode of operation. At the conclusion of any mode of operation, the second bushing 28 must be returned to the first position. The primary biasing member 20 has a force constant where, as the primary biasing member 28 is compressed, the primary biasing member 20 exerts a longitudinal force 64 that increases as the primary biasing member 20 is further compressed. The primary biasing member 20 can also be wound with its ends extending into recesses in the guide tube and second bushing 28, as described above, to impart a rotational force 66. This rotational force 66 remains substantially constant as the primary biasing member 20 is compressed during operation in any mode.

In FIG. 7, the rotational force 66 is greater than the longitudinal force 64 to locate the second bushing 28 in the first position. As the primary biasing member 20 is compressed in any mode of operation, the cam surfaces of the bushings engage and rotate the second bushing 28 to the second position. Then, as the primary biasing member 20 begins to expand, the longitudinal force 64 is initially greater than the rotational force 66, and the second bushing 28 remains in the second position. However, as the primary biasing member 20 continues to expand, the longitudinal force 64 becomes smaller and smaller, and eventually the longitudinal force 64 is less than the rotational force 66 such that the rotational force 66 resets the second bushing 28 to the first position.

Figure 8A:
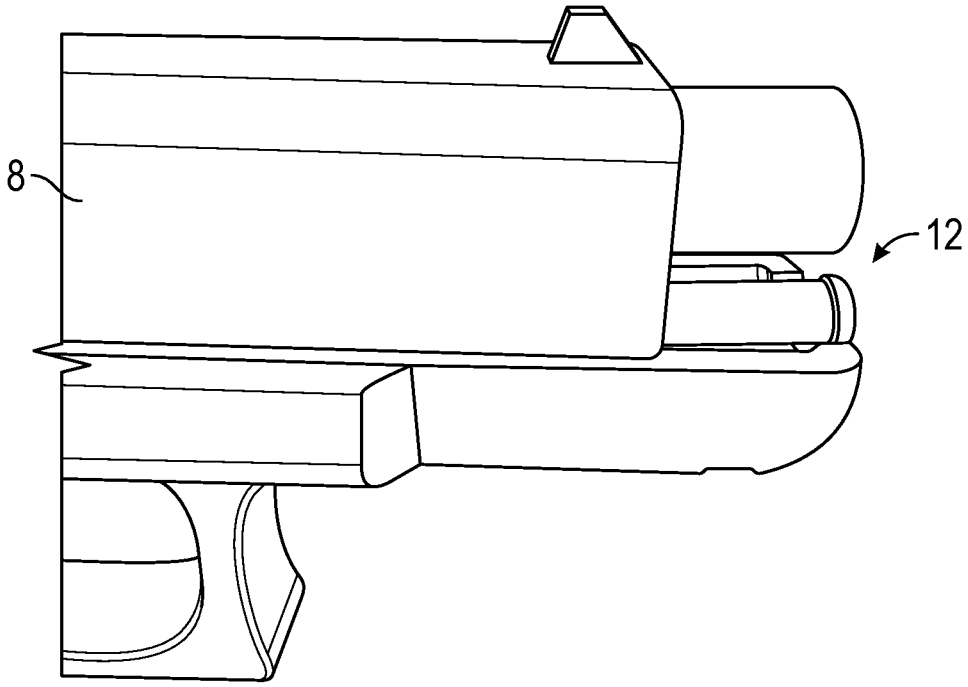
FIG. 8A (Prior Art)
FIG. 8A is a side elevation view of a prior art pistol during either a manual cycling or firing of the pistol.
Figure 8B:
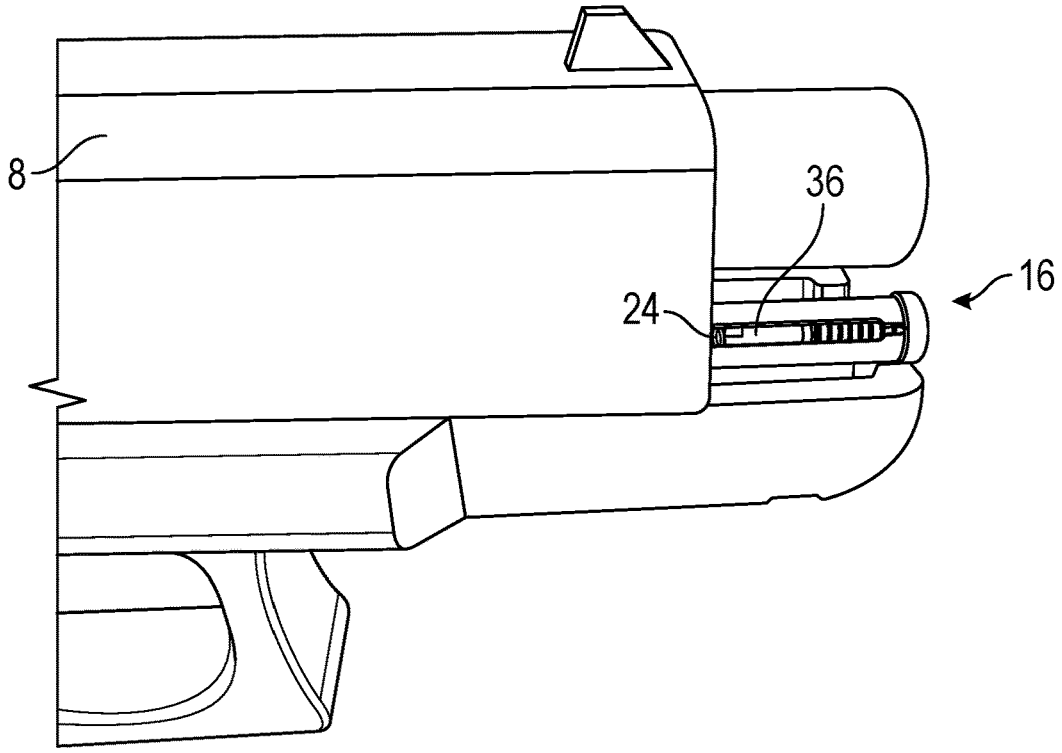
FIG. 8B is a side elevation view of the apparatus of FIG. 2 in a firearm during a first mode of operation in accordance with an embodiment of the present disclosure.
Figure 8C:
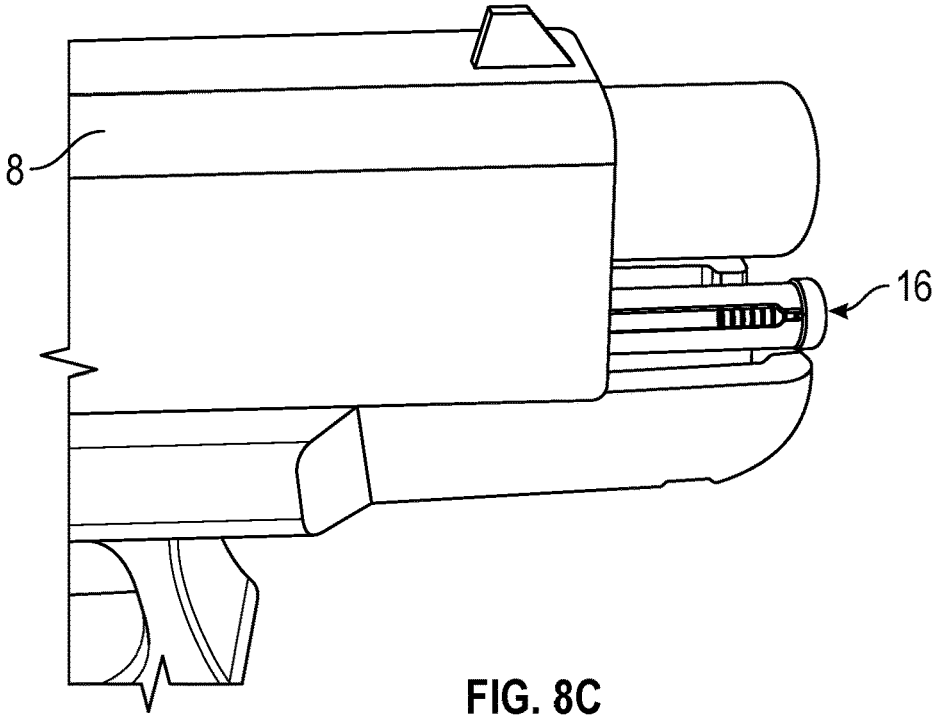
FIG. 8C is a side elevation view of the apparatus of FIG. 2 in a firearm during a second mode of operation in accordance with an embodiment of the present disclosure.

FIGS. 8A-8C show the operation of a prior art biasing member and the apparatus of the present disclosure in the context of a pistol. FIG. 8A shows a prior art biasing member 12 that compresses as the slide 8 of a pistol acts on the biasing member 12. The prior art biasing member 12 has the same force constant regardless of whether the slide 8 is moving in response to a small force like a user manually racking the slide 8 or in response to a large force when the pistol is firing.

In contrast, FIG. 8B shows the apparatus 16 of the present disclosure in a first mode of operation, and FIG. 8C shows the apparatus 16 in a second mode of operation. Specifically, FIG. 8B shows the pistol in a first mode of operation where a user is manually racking the slide 8. The apparatus 16 has therefore not engaged the piston 36 and the secondary biasing member 24, and only the lighter primary biasing member is compressed to provide an easier racking motion for the user. FIG. 8C shows the pistol in a second mode of operation where the pistol is firing, which exerts a greater force on the apparatus 16. As a result, the apparatus has engaged the piston and both of the primary and secondary biasing members are compressed to provide a sufficient force to operate the pistol as it fires.

While the figures show an apparatus that has a system of studs for selective engagement of a piston and a secondary biasing member, it will be appreciated that the present disclosure encompasses further embodiments of selective engagement. For example, in one embodiment, a freely rotatable first bushing can have a beveled end that can contact a retractor with a sufficient force, e.g., when a pistol is fired in a second mode of operation, to cause a retractor to engage a piston to compress both of a primary biasing member and a secondary biasing member. Further disclosure of such an exemplary embodiment can be found in Appendix D.

The description of the present disclosure has been presented for purposes of illustration and description, but is not intended to be exhaustive or limiting of the disclosure to the form disclosed. Many modifications and variations will be apparent to those of ordinary skill in the art. The embodiments described and shown in the figures were chosen and described in order to best explain the principles of the disclosure, the practical application, and to enable those of ordinary skill in the art to understand the disclosure.

While various embodiments of the present disclosure have been described in detail, it is apparent that modifications and alterations of those embodiments will occur to those skilled in the art. Moreover, references made herein to "the present disclosure" or aspects thereof should be understood to mean certain embodiments of the present disclosure and should not necessarily be construed as limiting all embodiments to a particular description. It is to be expressly understood that such modifications and alterations are within the scope and spirit of the present disclosure, as set forth in the following claims.

What is claimed is:

1. An apparatus for selectively changing a cycling force of a semi-automatic firearm, comprising:

a primary biasing member having a first force constant and a rotational force;

a secondary biasing member having a second force constant, wherein said primary and secondary biasing members are oriented along a longitudinal axis;

a bushing assembly having a first bushing with a first cam surface and having a second bushing with a second cam surface, wherein said first and second cam surfaces operably engage as said first and second bushings move toward each other along said longitudinal axis to rotate said second bushing from a first position to a second position;

wherein, when said primary biasing member is at a first displacement, a longitudinal force from said primary biasing member is greater than said rotational force, and said second bushing is in said second position; and wherein, when said primary biasing member is at a second displacement that is greater than said first displacement, said longitudinal force from said primary biasing member is less than said rotational force, and said rotational force resets said second bushing to said first position.

2. The apparatus of claim 1, further comprising a piston positioned in a guide tube, wherein at least one bushing stud extends from an inner surface of said second bushing, and at least one piston stud extends from an outer surface of said piston, wherein said at least one bushing stud selectively engages said at least one piston stud to selectively engage said secondary biasing member.

3. The apparatus of claim 2, further comprising at least one channel extending through a sidewall of said guide tube, wherein said at least one bushing stud and said at least one piston stud extend into said channel.

4. The apparatus of claim 2, wherein at least one guide stud extends inwardly from said first bushing into a groove of said guide tube to fix a rotational position of said first bushing as said first bushing moves along said guide tube.

5. The apparatus of claim 2, wherein said first cam surface is oriented at a first cam angle, and said second cam surface is oriented at a second cam angle that complements said first cam angle, wherein said first and second cam angles control timing and selective engagement of said at least one piston stud by said at least one bushing stud.

6. The apparatus of claim 1, wherein said first and second cam surfaces are flat such that said second bushing simultaneously moves along said longitudinal axis and rotates between said first and second positions.

7. The apparatus of claim 1, wherein said first cam surface is one of a plurality of first cam surfaces that are equally spaced about said first bushing, and said second cam surface is one of a plurality of second cam surfaces that are equally spaced about said second bushing.

8. An apparatus for selectively changing a cycling force of a semi-automatic firearm, comprising:

a guide tube adapted to be positioned in a slide of said semi-automatic firearm, wherein said guide tube extends from a first end to a second end;

a bushing assembly disposed around said guide tube, said bushing assembly having a first bushing and a second bushing, said second bushing rotatable between a first position and a second position;

a primary biasing member disposed around said guide tube and positioned between said bushing assembly and said second end of said guide tube, said primary biasing member having a first force constant and a rotational force;

a secondary biasing member positioned in an interior volume of said guide tube, said secondary biasing member having a second force constant;

a piston positioned in said interior volume of said guide tube;

wherein, when said primary biasing member is at an initial displacement, a longitudinal force from said primary biasing member is less than said rotational force, and said rotational force sets said second bushing to said first position; and wherein, when said primary biasing member is at a compressed displacement after said semi-automatic firearm is discharged, said longitudinal force from said primary biasing member is greater than said rotational force, and said longitudinal force sets said second bushing to said second position where said bushing assembly can selectively engage said piston and said secondary biasing member to provide an additional longitudinal force.

9. The apparatus of claim 8, further comprising a first recess in said bushing assembly and a second recess in said second end of said guide tube, wherein ends of said primary biasing member extend into said first and second recesses to establish said rotational force of said primary biasing member.

10. The apparatus of claim 9, wherein said first recess is one of a plurality of first recesses of said bushing assembly to adjust said rotational force of said primary biasing member.

11. The apparatus of claim 9, wherein said second recess is one of a plurality of second recesses of said guide tube to adjust said rotational force of said primary biasing member.

12. The apparatus of claim 8, wherein said first bushing has a first cam surface and said second bushing has a second cam surface, wherein said first and second cam surfaces operably engage as said first and second bushings move toward each other along a longitudinal axis to rotate said second bushing from said first position to said second position.

13. The apparatus of claim 12, wherein said first cam surface is oriented at a first cam angle, and said second cam surface is oriented at a second cam angle that complements said first cam angle.

14. An apparatus for selectively changing a cycling force of a semi-automatic firearm, comprising:

a guide tube positioned in a slide of said semi-automatic firearm, wherein said guide tube extends from a first end to a second end, and said second end has a guide recess;

a bushing assembly disposed around said guide tube proximate to said first end, said bushing assembly having a bushing recess;

a primary biasing member disposed around said guide tube and positioned between said bushing assembly and said second end of said guide tube, wherein a first end of said primary biasing member extends in said bushing recess and a second end of said primary biasing member extends into said guide recess, and wherein said primary biasing member has an adjustable rotational force;

a secondary biasing member positioned in an interior volume of said guide tube;

wherein, when said primary biasing member is at an initial displacement, a longitudinal force from said primary biasing member is less than said rotational force, and said rotational force moves said bushing assembly to a first position; and wherein, when said primary biasing member is compressed after said semi-automatic firearm is discharged, said longitudinal force from said primary biasing member is greater than said rotational force, and said longitudinal force moves said bushing assembly to a second position where said bushing assembly selectively engages said secondary biasing member.

15. The apparatus of claim 14, wherein said guide recess is one of a plurality of guide recesses, and said second end of said primary biasing member is selectively positionable in said plurality of guide recesses to adjust said rotational force of said primary biasing member.

16. The apparatus of claim 15, further comprising a cap engaged to said first end of said guide tube.

17. The apparatus of claim 16, wherein said cap is threadably engaged to said first end of said guide tube.

18. The apparatus of claim 14, wherein said bushing assembly has a first bushing and a second bushing, said second bushing is rotatable between said first position and said second position of said bushing assembly;

wherein, when said second bushing is in said first position, said bushing assembly cannot selectively engage said secondary biasing member; and wherein, when said second bushing is in said second position, said bushing assembly can selectively engage said secondary biasing member.

19. The apparatus of claim 18, further comprising a piston positioned in said guide tube, wherein said bushing assembly contacts said piston to engage said secondary biasing member.

20. The apparatus of claim 19, wherein a position of said piston within said guide tube is adjustable.

* * * * *